US009828807B2

(12) United States Patent
Zhou

(10) Patent No.: US 9,828,807 B2
(45) **Date of Patent: *Nov. 28, 2017**

(54) SYSTEM AND METHOD FOR FORMING A LATERAL WELLBORE

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/235,822

(22) Filed: Aug. 12, 2016

(65) Prior Publication Data

US 2016/0348441 A1 Dec. 1, 2016

Related U.S. Application Data

(63) Continuation of application No. 13/832,056, filed on Mar. 15, 2013, now Pat. No. 9,441,420.

(60) Provisional application No. 61/621,689, filed on Apr. 9, 2012.

(51) Int. Cl.

| | |
|---|---|
| ***E21B 7/04*** | (2006.01) |
| ***E21B 10/32*** | (2006.01) |
| ***E21B 10/26*** | (2006.01) |
| ***E21B 7/06*** | (2006.01) |
| ***E21B 4/02*** | (2006.01) |
| ***E21B 47/00*** | (2012.01) |

(52) U.S. Cl.

CPC ..... *E21B 10/322* (2013.01); *E21B 4/02* (2013.01); *E21B 7/046* (2013.01); *E21B 7/064* (2013.01); *E21B 7/067* (2013.01); *E21B 10/26* (2013.01); *E21B 47/00* (2013.01)

(58) Field of Classification Search

USPC ..... 175/61, 73

See application file for complete search history.

(56) References Cited

U.S. PATENT DOCUMENTS

| | | | |
|---|---|---|---|
| 2,227,233 | A | 12/1940 | Scott et al. |
| 3,139,147 | A | 6/1964 | Hays et al. |
| 4,333,539 | A | 6/1982 | Lyons et al. |

(Continued)

OTHER PUBLICATIONS

International Search Report and Written Opinion for Related PCT Application PCT/US2013/035754, dated Jun. 2, 2014.

*Primary Examiner* — Kyle Armstrong

(74) *Attorney, Agent, or Firm* — Bracewell LLP; Constance G. Rhebergen; Keith R. Derrington

(57) ABSTRACT

A lateral wellbore is formed from a high side of a horizontal portion of a primary wellbore with a drill bit assembly that has a selectively extendable pilot bit. The drill bit assembly is mounted on a lower end of a drill string. A bit guide is disposed adjacent the drill bit assembly for urging the drill bit assembly in a lateral direction against the high side of the primary wellbore. Rotating the drill bit assembly while urging the drill bit assembly upward creates a groove in a subterranean formation adjacent the primary wellbore. This forms a ledge at a far end of the groove. The drill string is then drawn back from the groove, and the pilot bit is deployed. Urging the drill bit assembly forward engages the pilot bit with the ledge, providing leverage for retaining the drill bit assembly in an orientation for excavating the lateral wellbore.

9 Claims, 6 Drawing Sheets

(56) References Cited

U.S. PATENT DOCUMENTS

| | | | | |
|---|---|---|---|---|
| 4,938,298 | A | 7/1990 | Rehm | |
| 5,009,273 | A | 4/1991 | Grabinski | |
| 5,094,304 | A | 3/1992 | Briggs | |
| 6,419,033 | B1 | 7/2002 | Hahn et al. | |
| 7,360,610 | B2 | 4/2008 | Hall et al. | |
| 2003/0010534 | A1 | 1/2003 | Chen et al. | |
| 2004/0238221 | A1* | 12/2004 | Runia | E21B 7/067 175/61 |
| 2009/0114449 | A1 | 5/2009 | Misselbrook et al. | |
| 2010/0181115 | A1 | 7/2010 | Eddison | |
| 2012/0031677 | A1* | 2/2012 | Schulte | E21B 7/064 175/61 |

* cited by examiner

SYSTEM AND METHOD FOR FORMING A LATERAL WELLBORE

CROSS-REFERENCE TO RELATED APPLICATION

This application claims priority to and the benefit of co-pending U.S. patent application having Ser. No. 13/832,056 and which was filed Mar. 15, 2013, and which claimed priority to Provisional Application 61/621,689, filed Apr. 9, 2012, the full disclosures of which are hereby incorporated by reference herein for all purposes.

BACKGROUND OF THE INVENTION

1. Field of the Invention

The present invention relates to operations in a wellbore. More specifically, the invention relates to a system and method for excavating a lateral wellbore from a primary wellbore.

2. Description of the Related Art

Hydrocarbon producing wellbores extend subsurface and intersect subterranean formations where hydrocarbons are trapped. The wellbores generally are created by drill bits that are on the end of a drill string, where a drive system above the opening to the wellbore rotates the drill string and bit. Cutting elements are usually provided on the drill bit that scrape the bottom of the wellbore as the bit is rotated and excavate material thereby deepening the wellbore. Drilling fluid is typically pumped down the drill string and directed from the drill bit into the wellbore. The drilling fluid flows back up the wellbore in an annulus between the drill string and walls of the wellbore. Cuttings produced while excavating are carried up the wellbore with the circulating drilling fluid. Drill strings are typically made up of tubular sections attached by engaging threads on ends of adjacent sections to form threaded connections.

In some instances the wellbore is made up of a primary or main wellbore with one or more lateral wellbores that branch from the main wellbore. Typically, lateral wellbores that branch from an existing open-hole horizontal portion of a main wellbore are initiated from a "low" side of the main wellbore because of the gravity effect and a lack of an anchor for the drill bit. This may seriously limit workover completion options for existing horizontal wellbores to control flow or optimize production of each lateral wellbore created.

SUMMARY OF THE INVENTION

Described herein are methods and apparatuses for excavating a lateral wellbore from a "high" side of a horizontal portion of a main wellbore. A drill bit assembly that has a selectively extendable pilot bit is mounted on a lower end of a drill string. Circumscribing or forming part of the drill string adjacent the drill bit assembly, a bit guide is provided for directing the drill bit against an upper wall of the main wellbore. Rotating the drill bit assembly while urging the drill bit assembly upward excavates a groove along the upper wall, and this forms a ledge at a far end of the groove. The drill string is then drawn back a short distance from the groove and the pilot bit is deployed from the drill bit assembly. Urging the drill bit forward engages the pilot bit with the ledge, providing leverage for retaining the drill bit in an orientation for creating the lateral wellbore.

According to one aspect of the invention, a method of branching a lateral wellbore from a primary wellbore includes the steps of (a) providing a drill bit assembly having a body with one or more cutting elements disposed thereon and a selectively deployable pilot bit; (b) inserting the drill bit assembly into the primary wellbore; (c) excavating a groove in the formation on a lateral side of the primary wellbore; (d) deploying the pilot bit; (e) engaging the groove with the pilot bit; and (f) rotating the drill bit assembly, so that the pilot bit guides the drill bit assembly into excavating contact with the groove and in an orientation for forming the lateral wellbore.

In some embodiments, a location of the groove ranges the circumference of the primary wellbore, and in some embodiments the location of the groove is on a high side of the primary wellbore.

In some embodiments, the method also includes the steps of (g) providing an axial urging force to the drill bit assembly for forming the lateral wellbore; (h) maneuvering the drill bit assembly to a predetermined angle of the lateral wellbore with respect to the primary wellbore; and (i) advancing the drill bit assembly in the direction of the predetermined angle.

In some embodiments, the method also includes the steps of (j) coupling the drill bit assembly to a lower end of a drill string; (k) rotating the drill string to orient the drill bit assembly such that the one or more cutting elements engage the formation on a high side of the primary wellbore to excavate the groove; (l) orienting the drill bit assembly at an angle with respect to a longitudinal axis of the drill string so the cutting elements contact a wall of the primary wellbore at a selected azimuth that corresponds with an azimuth of where the lateral wellbore intersects the primary wellbore, (m) deepening the groove by increasing the angle between the drill bit assembly and the longitudinal axis of the drill string, and (n) retracting the drill bit assembly from the lateral wellbore, moving the drill bit assembly to another designated location along the primary wellbore, and repeating steps (c)-(f) to form a second lateral wellbore.

In some embodiments, the method includes the step of (o) extending the pilot bit by providing a pressurized fluid to a bore in the body of the drill bit assembly.

In some embodiments, the method includes the step of (p) retracting the pilot bit with respect to the body of the drill bit assembly and maneuvering the drill bit assembly to a predetermined angle of the lateral wellbore with respect to the primary wellbore with the pilot bit retracted with respect to the body of the drill bit assembly.

According to another aspect of the invention, a method of excavating a lateral wellbore from a high side of an intermediate portion a primary wellbore extending through a subterranean formation includes the steps of (a) providing a side-tracking bottom hole assembly (BHA) that includes a drill bit assembly having a body with one or more cutting elements disposed thereon and selectively extendable pilot bit, the drill bit assembly selectively angled along an axis oblique to an axis of the primary wellbore (b) disposing the drill bit assembly at a designated sidetrack location; (c) adjusting the side-tracking BHA to a bend angle such that the one or more cutting elements are urged against the subterranean formation on a high side of the intermediate portion of the primary wellbore; (d) rotating the drill bit assembly to excavate a groove in the subterranean formation; (e) increasing the bend angle such that the pilot bit is oriented toward a ledge defined in the groove; (f) extending the pilot bit from within the body; (g) engaging the pilot bit with the ledge to anchor the drill bit assembly; and (h)

advancing the drill bit assembly through the ledge and into the subterranean formation adjacent the primary wellbore to excavate the lateral wellbore.

In some embodiments, the method includes (i) providing a mud motor having adjustable-angle bent housing for adjusting the bend angle of the side-tracking BHA. In some embodiments, the method further includes the steps of (j) coupling the side-tracking BHA to a drill string, and (k) rotating the drill string to orient the drill bit assembly toward the high side of the intermediate portion of the primary wellbore. In some embodiments, the step of rotating the drill bit assembly to excavate a groove in the subterranean formation includes providing a pressurized fluid to the side-tracking BHA to drive the mud motor. In some embodiments the step of extending the pilot bit from within the body includes providing the pressurized fluid to a bore in the body of the drill bit assembly.

In some embodiments, the pilot bit is maintained in a retracted position within the body during the step of rotating the drill bit assembly to excavate a groove in the subterranean formation. In some embodiments, the pressurized fluid is be provided to the side-tracking BHA at a pressure sufficient to drive the mud motor, and the pilot bit is maintained in the retracted position within the body by providing the pressurized fluid to the bore in the body at an insufficient pressure to extend the pilot bit from the body.

According to another aspect of the invention, a system for excavating a lateral wellbore from an intermediate portion of a primary wellbore includes a drill bit assembly having a body with one or more cutting elements disposed thereon and a selectively deployable pilot bit. The pilot bit is selectively extendable and retractable with respect to a forward face of the drill bit assembly. The system also includes a means for providing a lateral urging force to the drill bit assembly with respect to the intermediate portion of the primary wellbore, a means for rotating the drill bit assembly within the intermediate portion of the primary wellbore, a means for selectively extending the pilot bit and a means for selectively retracting the pilot bit.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1A:
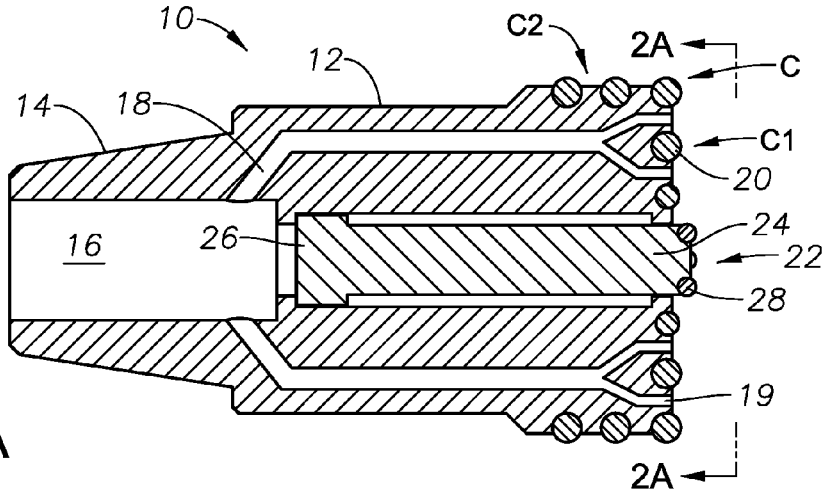
FIG. 1A is a side sectional view of an example embodiment of a drill bit assembly having a pilot bit in accordance with the present invention.
Figure 3:
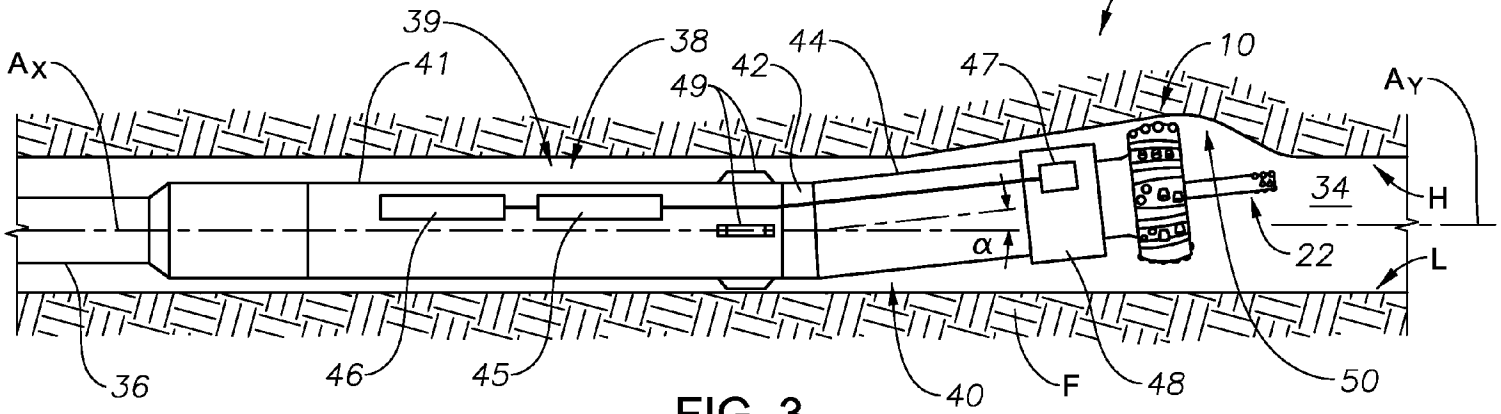
FIGS. 3-8 are side partial sectional views of the drill bit assembly of FIG. 1A used in forming a lateral wellbore in accordance with the present invention.

Shown in side sectional view in FIG. 1A is one example embodiment of a drill bit assembly 10 used in forming a lateral wellbore. The drill bit assembly 10 is shown having a cylindrically-shaped body 12 that has a threaded pin 14 mounted on its upper end for connection to a drill string 36 (FIG. 3). A bore 16 is shown axially extending through the threaded pin 14 and cylindrically-shaped body 12. Fluid passages 18 project radially outward from the bore 16, through the cylindrically-shaped body 12 and branch off into leads 19 that terminate on a cutting surface "C" of the drill bit assembly 10. On the cutting surface "C" are cutting elements 20 for scraping against and excavating subterranean formation when the drill bit assembly 10 is rotated within a wellbore. The cutting surface "C" generally includes a forward cutting face "C1" and a lateral cutting face "C2" extending around an end portion of the cylindrically-shaped body 12. A pilot bit 22 is shown coaxially disposed within a lower end of the bore 16 that includes a substantially cylindrical main body 24 and a collar 26 circumscribing an end of the substantially cylindrical main body 24 distal from the cutting surface "C" of the drill bit assembly 10. Cutting elements 28, similar to cutting elements 20, are shown on a leading end of the pilot bit 22 and opposite from the collar 26.

Figure 1B:
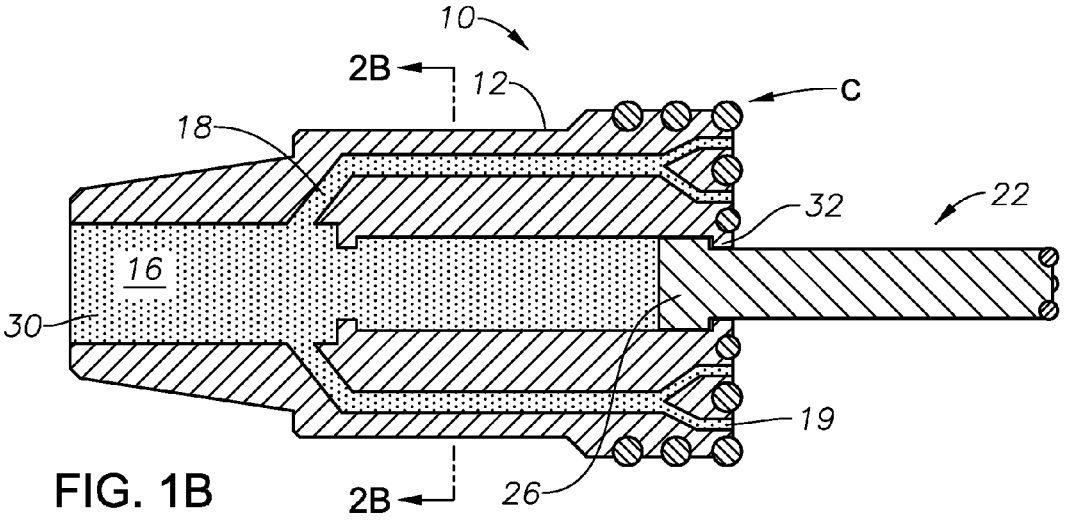
FIG. 1B is a side sectional view of the drill bit assembly of FIG. 1A with the pilot bit deployed in accordance with the present invention.

FIG. 1B illustrates an example of use of the drill bit assembly 10 where pressurized fluid 30 has entered the bore 16 from an annulus in the drill string 36 (FIG. 3). The pressurized fluid 30 flows into the fluid passages 18 and the leads 19, and exits the drill bit assembly 10 from where the leads 19 intersect with the cutting surface "C" of the drill bit assembly 10. The pressurized fluid 30 exerts a force onto the pilot bit 22 to deploy the pilot bit 22. In the example of FIG. 1B, the pilot bit 22 is deployed or extended from within the cylindrically-shaped body 12. In other examples (not shown) a pilot bit is deployed from other portions of a drill bit assembly, or a pilot bit is deployed by retracting a sheath (not shown) or other portion of a drill bit assembly. In the example of FIG. 1B, the pilot bit 22 remains engaged with the cylindrically-shaped body 12 by interference between the collar 26 and a shoulder 32. In the example of FIG. 1B, the shoulder 32 is a reduced radius portion of the bore 16 and adjacent the cutting surface "C" of the drill bit assembly 10. In some embodiments, complementary interengaging surface features (not shown) such as splines, divots, knurls, etc. on the shoulder 32 and the collar 26 and/or the substantially cylindrical main body 24 are employed to provide for the transmission of rotational motion of the cylindrically-shaped body 12 to the pilot bit 22. In other embodiments, the pilot bit 22 is rotationally isolated from the cylindrically-shaped body 12.

Figure 2A:
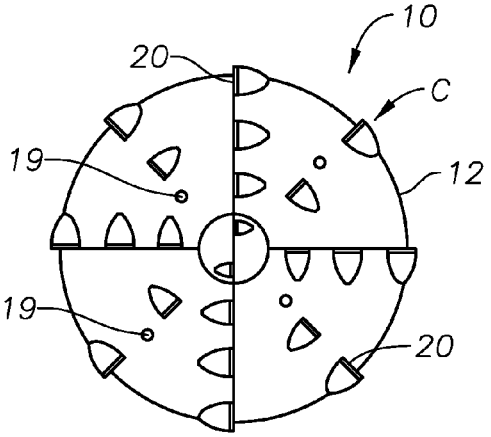
FIG. 2A is a plan view of a cutting surface of the drill bit assembly of FIG. 1A in accordance with the present invention.
Figure 2B:
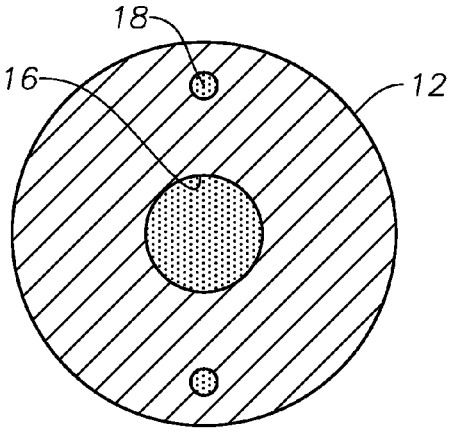
FIG. 2B is an axial sectional view of the drill bit assembly of FIG. 1B in accordance with the present invention.

A plan view of the cutting surface "C" is provided in FIG. 2A, which is taken along lines 2A-2A of FIG. 1A and illustrates example positions of the leads 19 and how they intersect the cutting surface "C" of the drill bit assembly 10. Optional arrangements of the cutting elements 20 are shown, where the cutting elements 20 extend radially outward from a midpoint of the cylindrically-shaped body 12 along a pair of intersecting lines that crisscross the cutting surface "C." A sectional view of the example of the drill bit assembly 10 is provided in FIG. 2B that is taken along lines 2B-2B of FIG. 1B. In this example, the fluid passages 18 are shown extending through the cylindrically-shaped body 12 and on opposite sides of the bore 16.

FIG. 3 illustrates an example of the drill bit assembly 10 in side view and included in an example of a side-tracking bottom hole assembly (BHA) 33. The side-tracking BHA 33 of FIG. 3 is disposed within a main or primary wellbore 34 shown extending through a subterranean formation "F" and defining a longitudinal axis $A_Y$. At least a portion of the primary wellbore 34 extends generally horizontally with respect to the surface of the earth such that a high side "H" and a low side "L" of the primary wellbore 34 are defined. The side-tracking BHA 33 is disposed within an intermediate portion of the primary wellbore 34, i.e., a portion remote from the bottom or terminal end of the primary wellbore 34. The drill bit assembly 10 is illustrated with its pilot bit 22 axially extended away from a terminal side or leading end of the drill bit assembly 10. The side-tracking BHA 33 is depicted mounted on a lower terminal end of a drill string 36; that in the example of FIG. 3, has an upper end coupled with a rotary table or top drive at surface (not shown) for providing rotational torque onto the drill string 36 and drill bit assembly 10. The side-tracking BHA 33 includes a bit guide 38, which is provided to orient the drill bit assembly 10 in a lateral direction with respect to the primary wellbore 34. The bit guide 38 is shown mounted adjacent the drill bit assembly 10. In one example, the bit guide 38 includes a mud motor 39 with an adjustable-angle bent housing 40. As one skilled in the art will appreciate, mud motor 39 permits rotation of the drill bit assembly 10 without the need for rotation of the entire drill string 36. Mud motor 39 generates a torque down-hole, which is selectively applied to the drill bit assembly 10, as pressurized fluid 30 (FIG. 1B) is transmitted through the mud motor 39. In other embodiments, the drill string 36 extends through the bit guide 38, as depicted in FIG. 3, to provide torque and rotational motion to the drill bit assembly 10. In other example embodiments, a bit guide (not shown) comprises a rotary steerable system (RSS) capable of orienting the drill bit assembly 10 toward the high side "H" of the primary wellbore by exerting a longitudinal force on the low side "L" of the primary wellbore 34.

Figure 8:
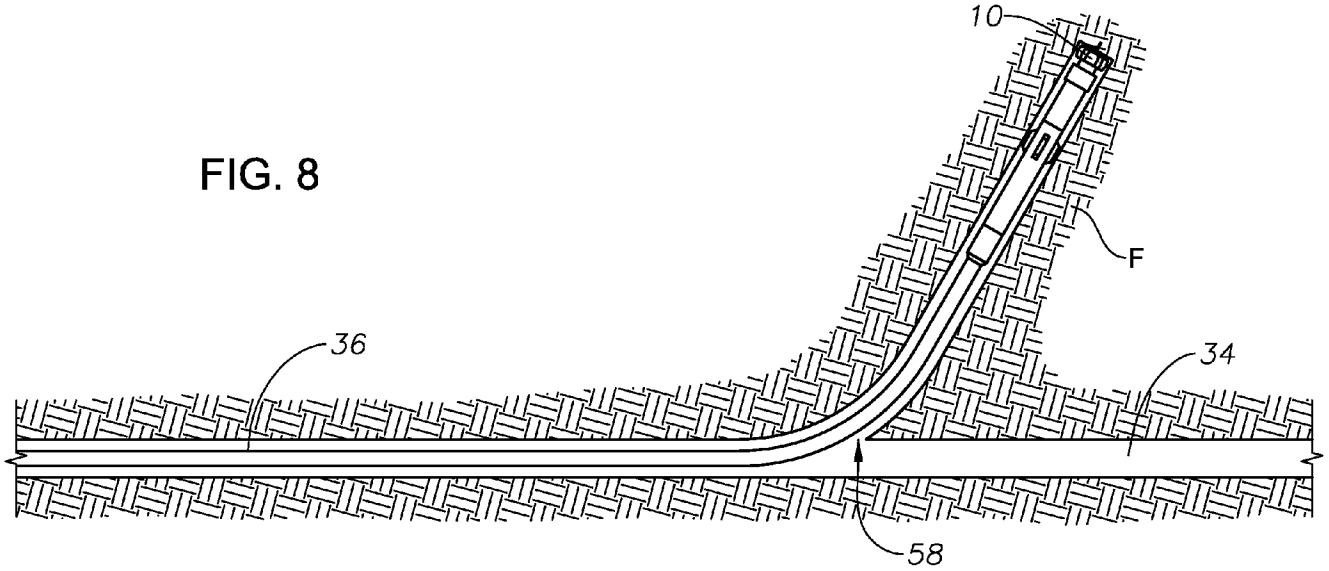

In the example of FIG. 3, the adjustable-angle bent housing 40 of mud motor 39 includes segments 41, 42, 44 that couple end-to-end to one another. Segments 42 and 44 are axially offset from one another to define a bend angle "α" with respect to a longitudinal axis $A_X$ of the drill string 36. The bend angle "α" is selectively adjustable from surface, which, in one example ranges from about 0 degrees to about 3 degrees. In other embodiments the bend angle "α" is adjustable over other ranges. As one skilled in the art will appreciate, various methods have been employed to adjust the angle of bent housings from the surface. A greater bend angle "α" generally provides a shorter radius of curvature of any new lateral wellbore 58 (FIG. 8).

In an optional example, the side-tracking BHA 33 is also provided with a measurement while drilling (MWD) payload 45 (represented schematically) coupled to a communication link 46 and a sensor package 47. Embodiments of the MWD payload 45 include circuitry, memory or other electronic components to permit the MWD payload 45 to receive data from the sensor package 47 and transmit data uphole through the communication link 46. The sensor package 47 is disposed at or near the drill bit assembly 10, and in some embodiments, include accelerometers, magnetometers, gyroscopic devices, or any other instrumentation for determining the true vertical depth and orientation (inclination and azimuth) of the drill bit assembly 10, as well as other parameters such as toolface, which are informative during drilling operations. In various embodiments, the communication link 46 includes wired communications systems, mud-pulse telemetry systems, or other communications systems generally known in the art.

Further included with side-tracking BHA 33 is a radial band 48 shown coupled on a lower terminal end of segment 44. The radial band 48 is optionally referred to as a bit sub. In the example of FIG. 3, optional stabilizers 49 are provided on an outer surface of segment 41 for primarily reducing tool vibration of the bit guide 38 as the drill string 36 moves without rotating along the primary wellbore 34, and while drill bit assembly 10 and radial band 48 are rotated by bit guide 38.

In an example embodiment of use of the side-tracking BHA 33, an appropriate location for a lateral wellbore 58 (FIG. 8) is determined, and the drill bit assembly 10 is inserted into the primary wellbore 34. The drill string 36 is rotated, thereby rotating the bit guide 38 and drill bit assembly 10 about the common axis $A_X$, until readings provided by the MWD payload 45 indicate that the drill bit assembly 10 is disposed at an appropriate depth, and is oriented upward into contact with an upper wall or the high side "H" of the primary wellbore 34. Rotation of the drill string 36 is then suspended, and the upward orientation of the drill bit assembly 10 is maintained. Pressurized fluid 30 (FIG. 1B) is then pumped though the drill string 36 and mud motor 39 to deploy the pilot bit 22 and rotate the drill bit assembly 10. As the rotating drill bit assembly 10 is urged by the bit guide 38 against the high side "H" of the primary wellbore 34, a groove 50 is shown being formed by excavation of the subterranean formation "F" adjacent the primary wellbore 34. Initially, although deployed, the pilot bit 22 does not contact the subterranean formation "F" in some example uses. In some other example embodiments of use, the pilot bit 22 is disposed and maintained in a retracted position within the cylindrically shaped body 12 (FIG. 1A) as the groove 50 is excavated. To maintain the pilot bit 22 in the retracted position, pressurized fluid 30 (FIG. 1B) is provided at a sufficient pressure to operate the mud motor 39, but an insufficient pressure to extend the pilot bit 22.

Figure 4:
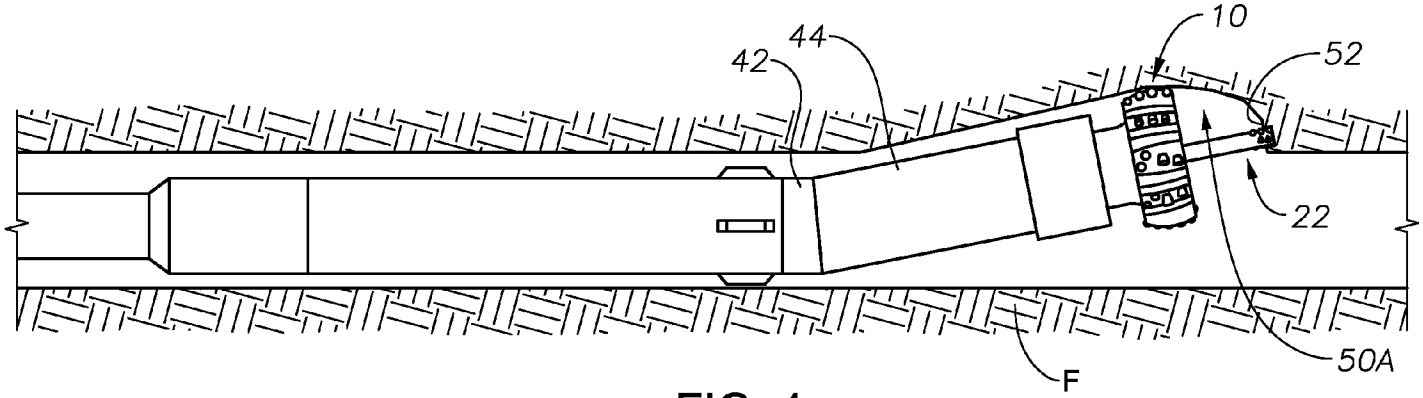

As shown in FIG. 4, an enlarged groove 50A has been formed from the groove 50 of FIG. 3 by continued rotation of the drill bit assembly 10 and increasing the bend angle "α" between segments 42, 44. In an example, the bend angle "α" between segments 42 and 44 is adjustable automatically in response to parameters controllable from the surface including a variable differential pressure across the mud motor 39, weight applied to the mud motor 39 or drill bit assembly 10 from above, or a combination of both. In an optional embodiment, a drilling mud motor (not shown) is provided, which has a fixed-angle bent-housing, whose angle is locked at surface before running into well, primarily to prolong motor working hours and reduce risk of tool internal mechanical failure. In some examples, special purpose runs need to employ an automatically adjustable bent-housing of a mud motor, such as in sidetrack operations where a relatively short time is available to enable a drill bit to initiate a sidetrack wellbore.

Figure 5:
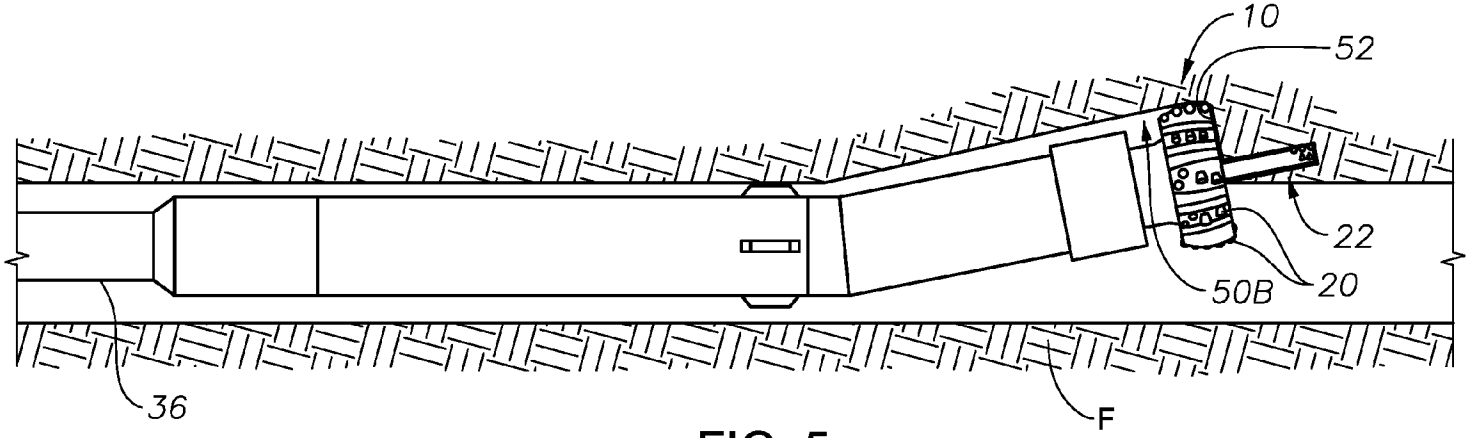

A ledge 52 is shown formed on a forward end of groove 50A. The ledge 52 is defined by a change in curvature of the groove 50A. In the example of FIG. 4, the change in curvature of the groove 50A was generated as the forward cutting face "C1" (FIG. 1A) engaged the ledge 52, and the lateral cutting face "C2" engaged the formation "F" adjacent the ledge 52. Groove 50A provides sufficient clearance to permit the deployed pilot bit 22 to engage the ledge 52. When sufficient clearance is available, an operator pulls back on the drill string 36 and deploys the pilot bit 22. The operator then advances the drill string 36 such that the ledge 52 is engaged by the pilot bit 22 to anchor the drill bit assembly 10, as shown. Once the ledge 52 is engaged, the operator first slacks-off to test anchor provided the pilot bit 22 before advancing the drill string 36 to continue drilling. Engaging the ledge 52 with the pilot bit 22 and urging the pilot bit 22 deeper into the subterranean formation "F," provides leverage for the excavating action of the cutting elements 20 on the drill bit assembly 10 to facilitate enlarging the groove 50A yet further to form a groove 50B (FIG. 5). With the pilot bit 22 engaged with the ledge 52, additional weight is placed on the drill bit assembly 10, which allows the operator to increase a rate of excavation. Depending on the pressure of the pressurized fluid 30 (FIG. 1B), the pilot bit 22 is driven deeper into the formation "F" as the drill string 36 is advanced in some example embodiments, and the pilot bit 22 is urged into the bore 16 (FIG. 1B) of the drill bit assembly 10 in other example embodiments.

Figure 6:
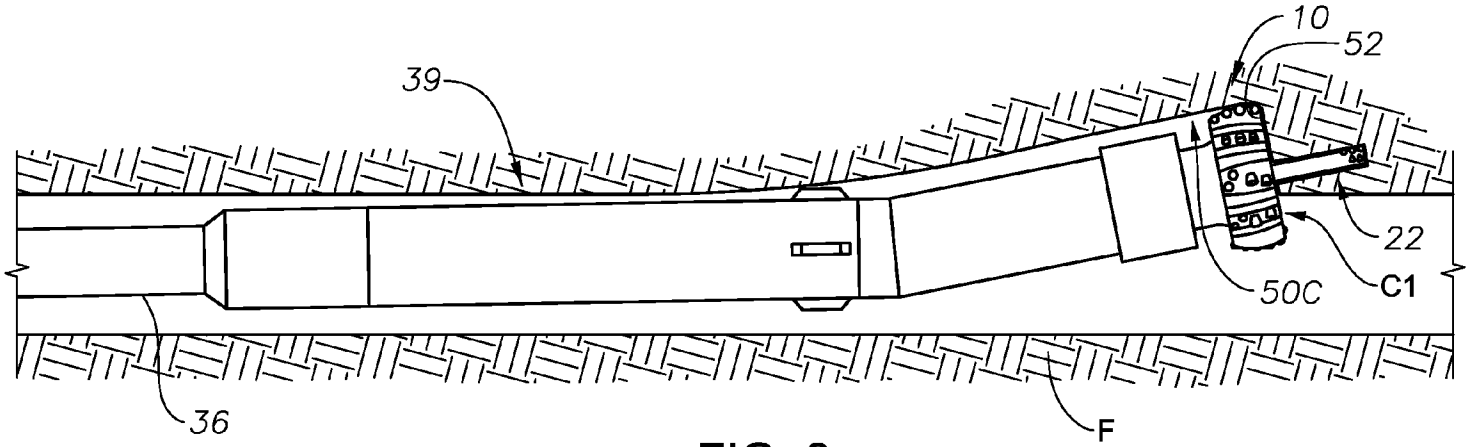

As shown in the example of FIG. 6, further downward urging on the drill string 36 deepens the engagement of the pilot bit 22 with the ledge 52 and further axially extends groove 50C. The forward cutting face "C1" comes into contact the subterranean formation "F" generating an increase in reactive torque. Drilling continues by advancing the drill string 36 and continuing to supply pressurized fluid 30 (FIG. 1B) to drive the mud motor 39. Continued drilling increases a surface area on the ledge 52, which is available for anchoring the drill bit assembly 10 with the pilot bit 22.

Figure 7:
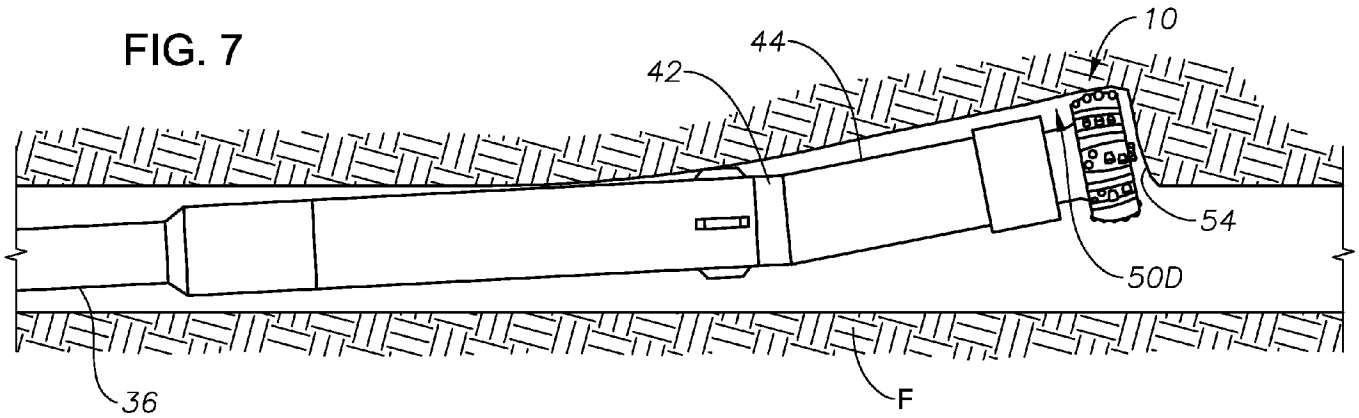

As illustrated in the example of FIG. 7, the pilot bit 22 is retracted into the drill bit assembly 10 to facilitate the establishment of a new anchor point on ledge 54. In some examples, the pilot bit 22 is retracted by applying a weight on the drill bit assembly 10 from the surface, e.g., against the ledge 54. Once retracted, the bend angle "α" between the segments 42, 44 is increased further. Retraction of the pilot bit 22 provides sufficient maneuverability of the drill bit assembly 10 within groove 50D to allow the pilot bit 22 to be engaged with ledge 54 at a location higher than the previous location. Once the pilot bit 22 is re-engaged with the formation "F" on the ledge 54, drilling continues. Repeating the above described process, eventually orients the drill bit assembly 10 at a predetermined or desired angle of a lateral wellbore 58, as illustrated in partial side sectional view in FIG. 8. Once the drill bit assembly 10 is oriented at the desired angle of the lateral wellbore 58, an axial urging force provided to the drill bit assembly 10 advances the drill bit assembly 10 through the ledge 54 and into the subterranean formation "F" adjacent the primary wellbore 34 to excavate the lateral wellbore 58.

Figure 9:
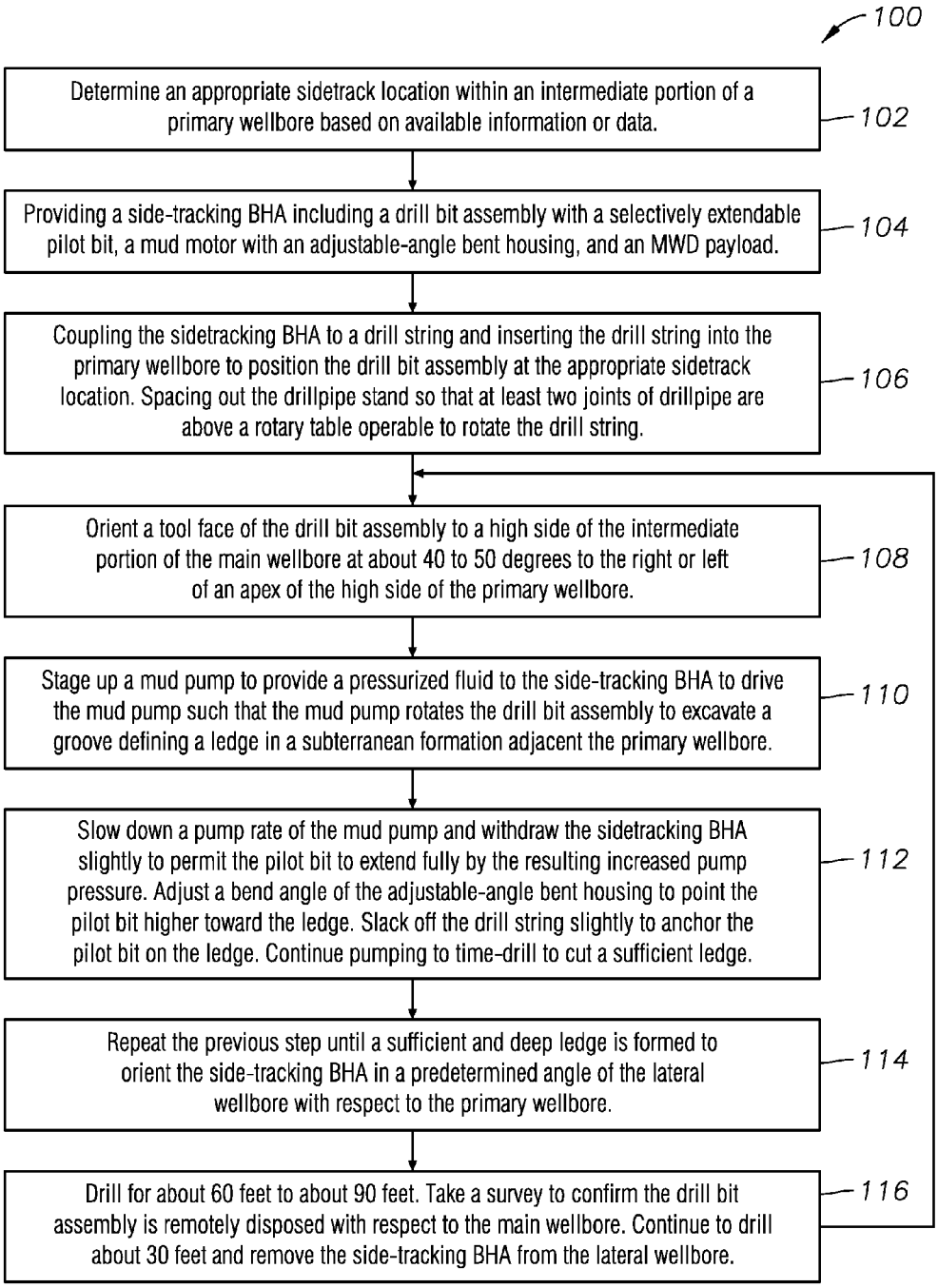
FIG. 9 is a flow diagram illustrating an example embodiment of an operational procedure in accordance with the present invention.
Figure 10:
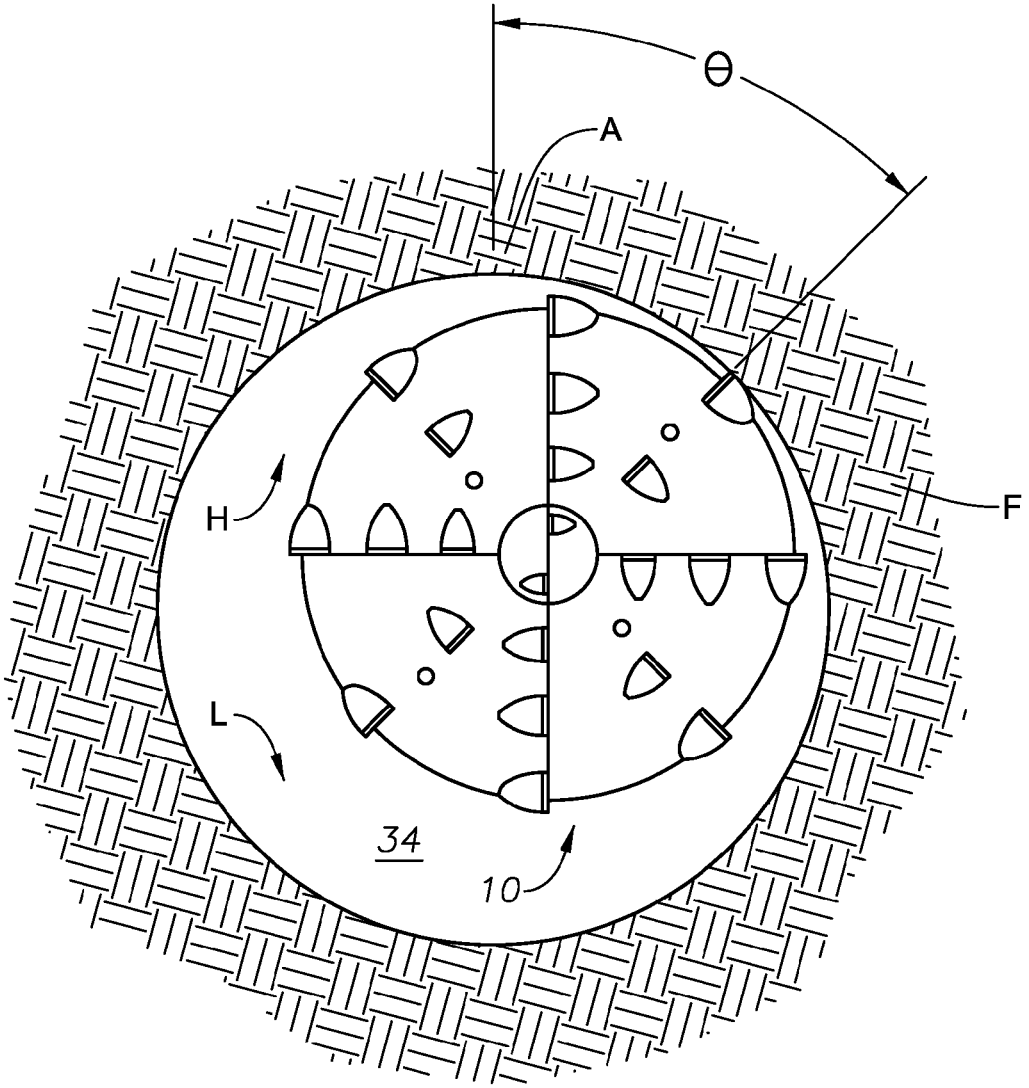
FIG. 10 is a plan view of the drill bit assembly of FIG. 1A positioned and oriented in a main wellbore for excavating a groove in a high side of the main wellbore.

In one example of an operational procedure 100, as depicted in FIG. 9, an appropriate side track location is determined in the primary wellbore 34 (step 102). The side-tracking BHA 33 (FIG. 3) is assembled and provided (step 104). The side-tracking BHA 33 is coupled to a drill string 36, and to avoid the need for making a drill pipe connection at the rotary table during a side-tracking operation, a drill pipe stand is appropriately spaced so that at least two joints of drill pipe are above the rotary table (step 106). Initially, to form the groove 50 (FIG. 3), the drill bit assembly 10 is oriented at an orientation angle "θ" in the range of about +/−40 to 50 degrees from an apex "A" (FIG. 10) of the high side "H" of the primary wellbore 34 looking downward or upward (step 108). In other embodiments, a selected azimuth for the groove 50A includes any location along the circumference of the primary wellbore 34. While the groove 50A and ledge 52 (FIG. 4) are being formed, a pump rate of a mud pump and a discharge pressure are increased (step 110). Prior to pulling back the drill bit assembly 10 from the groove 50A, the pump rate is slightly reduced and then increased to deploy the pilot bit 22 from within body 12 (FIG. 1B) of the drill bit assembly 10 (step 112). Repeating steps of excavating and backing off are continued until a desired offset angle is achieved for forming the lateral wellbore 58 (step 114). It is believed it is within the capabilities of those skilled in the art to determine the number of drawbacks and re-engagements. When initially forming the lateral wellbore 58, drilling proceeds from a distance of up to around 100 feet before a survey is taken to confirm that the side track path is directed in a location adjacent the primary wellbore 34. Then, further drilling of up to around 50 feet takes place before the side-tracking BHA 33 is withdrawn from the lateral wellbore 58 and/or from the primary wellbore 34 (step 116). In some examples, additional equipment (not shown) is inserted into the lateral wellbore 58 to continue drilling if desired. When the side-tracking BHA is retracted or withdrawn from the lateral wellbore 58, the side-tracking BHA is moved up-hole or down-hole to another designated location along the primary wellbore 34 that is remote from the lateral wellbore 58, and steps 108, 110, 112, 114 and/or 166 are repeated to form a second lateral wellbore that is remote or distinct from the lateral wellbore 58.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for excavating a lateral wellbore from an intermediate portion of a primary wellbore, the system comprising:

a bottom hole assembly comprising tubular segments coupled end-to-end to one another and a drill bit assembly attached to an end of one of the segments, the drill bit assembly comprising a body with one or more cutting elements disposed thereon and a pilot bit that is selectively extendable and retractable with respect to a forward face of the drill bit assembly;

a means for selectively axially offsetting the segments from one another to define a bend angle with respect an axis of the primary wellbore, and so that when a one of the segments is in contact with a low side of the primary wellbore, cutting elements on the drill bit assembly are in contact with a hi h side of the primary wellbore; and a means for rotating the drill bit assembly within the intermediate portion of the primary wellbore at the same time the angle of the drill bit assembly is being changed.

2. The system of claim 1, further comprising a bore in the body that is in fluid communication with a source of pressurized fluid, fluid passages in the body that are in fluid communication with the bore, and leads in the body that are in communication with the fluid passages and that have an end that intersects with a cutting surface on the body, so that when fluid is delivered to the bore at a pressure sufficient to deploy the pilot bit, the fluid exerts a force onto the pilot bit to selectively deploy the pilot bit from the body, and the fluid flows through the fluid passages and leads and is discharged from the leads at the cutting surface.

3. The system of claim 1, further comprising a payload that indicates a depth of the drill bit assembly and if the drill bit is located on a high side of the primary wellbore.

4. The system of claim 3, wherein when the segments are axially offset from one another and a side of the drill bit is urged into contact with a high side of the primary wellbore, the drill bit assembly forms a groove in the high side of the primary wellbore.

5. The system of claim 4, wherein the pilot bit remains retracted in the drill bit when the groove is formed.

6. The system of claim 1, wherein the means for rotating the drill bit assembly comprises a mud motor, wherein the drill bit assembly is attached to an end of a drill string, and wherein the drill string is selectively rotated.

7. The system of claim 6, wherein the mud motor operates at a pressure that is less than a pressure in the drill bit assembly that is required to deploy the pilot bit.

8. An earth boring system comprising:

a drill bit assembly coupled with a selectively rotatable drill string, the drill bit assembly comprising, a body, cutting elements on the body and a pilot bit selectively deployable from the body;

a mud motor;

segments between the drill bit assembly and drill string, the segments having axes that are automatically offset from one another in response to a pressure drop across the mud motor and that defines a bend in the bit assembly; and a means for rotating the drill bit assembly within the intermediate portion of the primary wellbore at the same time the angle of the drill bit assembly is being changed.

9. An earth boring system comprising:

a drill bit assembly that is attached to an end of a selectively rotatable drill string, the drill bit assembly comprising, a body, cutting elements on the body, a pilot bit selectively deployable from the body, a mud motor;

tubular segments coupled together in series, and having an uphole end attached to a drill string, and a downhole end attached to the drill bit assembly, the tubular segments having axes that are automatically offset from one another in response to a weight applied to the mud motor and that defines a bend in the tubular segments; and a means for rotating the drill bit assembly within the intermediate portion of the primary wellbore at the same time the angle of the drill bit assembly is being changed.

* * * * *